US011475842B2

(12) United States Patent
Wang

(10) Patent No.: US 11,475,842 B2
(45) Date of Patent: Oct. 18, 2022

(54) DISPLAY DEVICE AND DRIVING METHOD THEREOF

(71) Applicant: AU OPTRONICS CORPORATION, Hsin-Chu (TW)

(72) Inventor: Cheng-Kuang Wang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 336 days.

(21) Appl. No.: 16/691,673

(22) Filed: Nov. 22, 2019

(65) Prior Publication Data

US 2020/0184897 A1 Jun. 11, 2020

(30) Foreign Application Priority Data

Dec. 11, 2018 (TW) ..... 107144600

(51) Int. Cl.
*G09G 3/3266* (2016.01)
*G09G 3/3275* (2016.01)
*G09G 3/36* (2006.01)

(52) U.S. Cl.
CPC ..... *G09G 3/3266* (2013.01); *G09G 3/3275* (2013.01); *G09G 3/3677* (2013.01); *G09G 3/3688* (2013.01); *G09G 2310/0264* (2013.01)

(58) Field of Classification Search
CPC .. G09G 3/3266; G09G 3/3275; G09G 3/3614; G09G 3/3659; G09G 3/3225–3258; G09G 3/3677; G09G 3/3688; G09G 2310/0264
See application file for complete search history.

(56) References Cited

U.S. PATENT DOCUMENTS

| | | | | |
|---|---|---|---|---|
| 9,886,922 | B2 | 2/2018 | Du | |
| 10,417,978 | B2 * | 9/2019 | Kim | G02F 1/136286 |
| 2011/0285950 | A1 * | 11/2011 | Su | G09G 3/3614 349/139 |
| 2012/0169688 | A1 * | 7/2012 | Chen | G09G 3/003 345/209 |
| 2016/0314736 | A1 * | 10/2016 | Sang | G09G 3/3674 |
| 2016/0351136 | A1 | 12/2016 | He et al. | |
| 2017/0162140 | A1 | 6/2017 | Kim | |
| 2021/0256894 | A1 * | 8/2021 | Yoo | G09G 3/2007 |

FOREIGN PATENT DOCUMENTS

CN 107145021 A 9/2017

OTHER PUBLICATIONS

China Patent Office "Office Action" dated Mar. 21, 2022, China.

* cited by examiner

*Primary Examiner* — Dorothy Harris
(74) *Attorney, Agent, or Firm* — WPAT, PC

(57) ABSTRACT

A display device includes a plurality of pixel electrodes, a plurality of gate lines, and a plurality of data lines. The pixel electrodes arranged in a matrix include a plurality of first color pixel electrodes. The gate lines are configured to sequentially provide a plurality of gate signals to the pixel electrodes in a plurality of line times. The data lines are configured to provide a plurality of the first data voltages and a plurality of the second data voltages to the first color pixel electrodes. The polarity of the first data voltages is opposite to the polarity of the second data voltages in the same frame. In each of the line times, the number of the first color pixel electrodes receiving the first data voltage is substantially equal to the number of the first color pixel electrodes receiving the second data voltages.

13 Claims, 6 Drawing Sheets

| | | T1 | T2 | T3 | T4 | T5 | T6 |
|---|---|---|---|---|---|---|---|
| + | D1 | R | G | B | R | G | B |
| - | D2 | G | B | R | G | B | R |
| + | D3 | B | R | G | B | R | G |
| - | D4 | R | G | B | R | G | B |
| + | D5 | G | B | R | G | B | R |
| - | D6 | B | R | G | B | R | G |

DISPLAY DEVICE AND DRIVING METHOD THEREOF

BACKGROUND

Technical Field

The present invention relates to an electronic device and a driving method thereof, and in particular, the present invention relates to a display device and a driving method thereof.

Related Art

With the rapid development of electronic technology, display devices have been widely used in people's lives, such as mobile phones or computers.

In general, a display device can include a plurality of electrodes and a display layer. The display device provides different voltages to the electrodes to create an electric field between the electrodes to reverse the display elements in the display layer. The display screen of the display device can be controlled by controlling the reversing of the display element. However, in the pixel circuit, when the ground color is a solid color, the data voltage has a strong pull on the voltage (generally called Vcom) on the common electrode, which causes the screen display noise (such as horizontal crosstalk (H-crosstalk)).

Therefore, how to improve the pixel electrodes driving method to avoid the screen display noise is an important research topic in the field.

SUMMARY

An embodiment of the present invention relates to a display device. According to an embodiment of the present invention, a display device includes a plurality of pixel electrodes, a plurality of scanning lines, and a plurality of data lines. The plurality of pixel electrodes arranged in a matrix includes a plurality of first color pixel electrodes. A plurality of scanning lines is configured to sequentially provide a plurality of scanning signals to the pixel electrodes in a plurality of line times, one of the scanning lines electrically connected to corresponding switches of adjacent two lines of the pixel electrodes in the pixel electrodes. A plurality of data lines, wherein one of the data lines is electrically connected to the pixel electrodes located at different rows in the pixel electrodes. Wherein the data lines for providing a plurality of first data voltages and a plurality of second data voltages to the first color pixel electrodes, the first data voltages are opposite in polarity to the second data voltages in the same frame, and in each of the line times, the number of the first color pixel electrodes receiving the first data voltage is substantially equal to the number of the first color pixel electrodes receiving the second data voltages.

An embodiment of the present invention relates to a display device. According to an embodiment of the present invention, a display device includes a plurality of pixel electrodes, a plurality of scanning lines, and a plurality of data lines. The plurality of pixel electrodes arranged in a matrix includes a plurality of first color pixel electrodes. A plurality of scanning lines is configured to sequentially provide a plurality of scanning signals to the pixel electrodes in a plurality of line times, one of the scanning lines electrically connected to corresponding switches of adjacent two lines of the pixel electrodes in the pixel electrodes. A plurality of data lines, wherein one of the data lines electrically connect to adjacent two rows of pixel electrodes in the pixel electrodes, wherein adjacent a first and a second of the data lines are disposed between adjacent two rows pixel electrodes in the pixel electrodes. The data lines are configured to provide a plurality of first data voltages and a plurality of second data voltages to the first color pixel electrodes, wherein the first data voltages are opposite in polarity to the second data voltages in the same frame, and in each of line times, the number of the first color pixel electrodes receiving the first data voltages is substantially equal to the number of the first color pixel electrodes receiving the second data voltages.

An embodiment of the present invention relates to a driving method of a display device. According to an embodiment of the present invention, a driving method of a display device includes that sequentially provides a plurality of scanning signals to a plurality of the pixel electrodes in a plurality of line times through a plurality of scanning lines, wherein one of the scanning lines electrically is connected to the corresponding switch of adjacent two lines of the pixel electrodes in the pixel electrodes. The plurality of pixel electrodes arranged in a matrix includes a plurality of first color pixel electrode, and provide a plurality of first data voltages and a plurality of second data voltages to the first color pixel electrodes, wherein the first data voltages are opposite in polarity to the second data voltages in the same frame, and in each of line times, the number of the first color pixel electrodes receiving the first data voltages is substantially equal to the number of the first color pixel electrodes receiving the second data voltages.

As a preferably embodiment, wherein the pixel electrodes further include a plurality of second color pixel electrodes and a plurality of third color pixel electrodes; wherein, the data lines are configured to provide a plurality of third data voltages and a plurality of fourth data voltages to the second color pixel electrodes, and configured to provide a plurality of fifth data voltages and a plurality of sixth data voltages to the third color pixel electrodes, the third data voltages are opposite in polarity to the fourth data voltages in the same frame, and the fifth data voltages are opposite in polarity to the sixth data voltages in the same frame; and in each of the line times, the number of the second color pixel electrodes receiving the third data voltages are substantially equal to the number of the second color pixel electrodes receiving the fourth data voltages, the number of the third color pixel electrodes receiving the fifth data voltages are substantially equal to the number of the third color pixel electrodes receiving the sixth data voltages; wherein the first data voltages, the third data voltages, and the fifth data voltages have the same polarity in the same frame, the second data voltages, the four data voltages, and the sixth data voltages having the same polarity in the same frame; wherein, the pixel electrode of the first color pixel electrode receiving one of the first data voltages is adjacent to the pixel electrode of the first color pixel electrode receiving one of the second data voltages, the pixel electrode of the second color pixel electrode receiving one of the fourth data voltages, and the pixel electrode of the third color pixel electrode receiving one of the sixth data voltages; and the pixel electrode of the first color pixel electrodes receiving one of the second data voltages is adjacent to the pixel electrodes of the first color pixel electrodes receiving one of the first data voltages, the pixel electrode of the second color pixel electrodes receiving one of the third data voltages, and the pixel electrode of the third color pixel electrodes receiving one of the fifth data voltages.

BRIEF DESCRIPTION OF THE DRAWINGS in order to make the above and other objects, features, advantages, and embodiments of the present invention more clearly and easily understood, the illustration of the attached figures are as follows.

DETAILED DESCRIPTION

Figure 1:
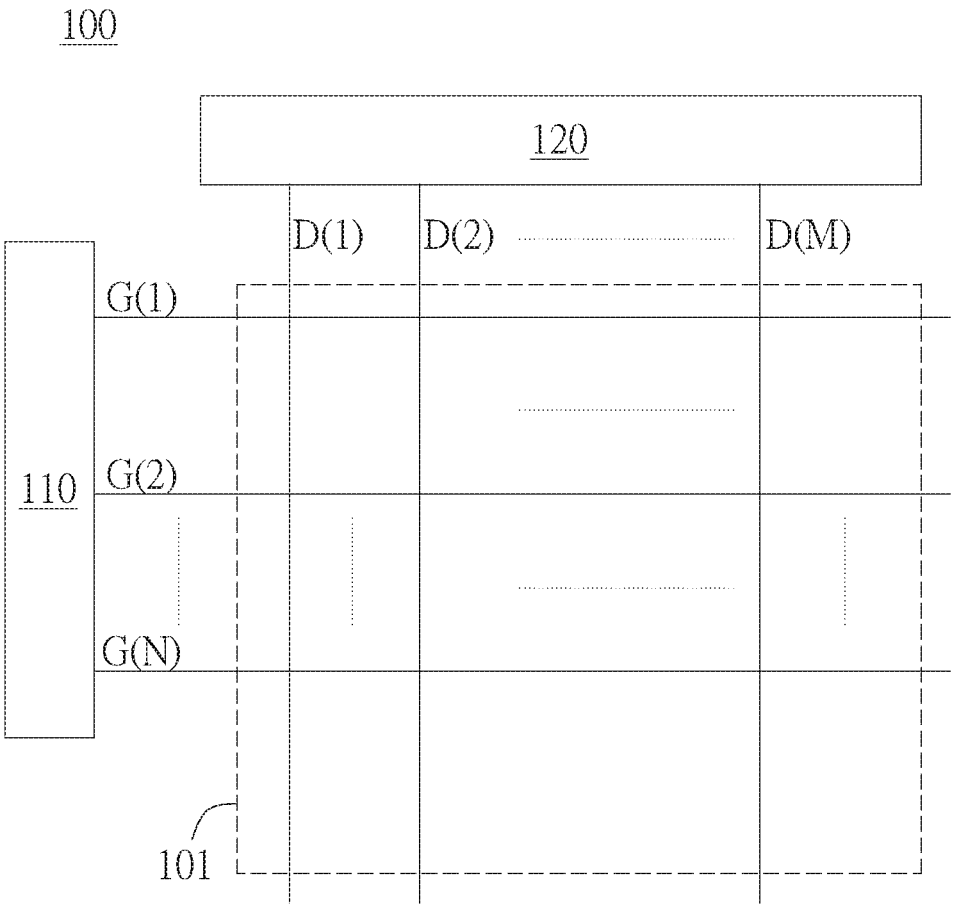
FIG. 1 is a schematic diagram of a display device in accordance with an embodiment of the present invention.

Throughout the specification, the same reference numerals denote the same elements. It will be understood that when an element such as a layer, a film, a region or a substrate is referred to as "on the" or "connected to" another element, it can be directly on the other element or connected to the other element, or the intermediate elements can also be present. In contrast, when an element is referred to as "directly on the other element" or "directly connected" to another element, there is no intermediate element. As used herein, "connected" may refer to both physical and/or electrical connections. Furthermore, "electrical connection" or "coupling" can be the presence of other elements between two elements.

It should be understood that although the terms "first", "second", "third" can be used herein to describe various elements, components, regions, layers and/or parts, however such elements, components, regions, and/or parts should not be limited by these terms. These terms are used only to distinguish one element, component, region, layer or part from another element, component, region, layer or part. Therefore, the "first element", "component", "region", "layer" or "part" discussed below can be referred to as the second element, component, region, layer or part without departing from the teachings of this article.

The terminology used herein is for the purpose of describing particular embodiments. As used herein, unless the context clearly indicates otherwise, the singular forms "a", "one" and "the" are intended to include the plural forms, including "at least one". "Or" means "and/or". As used herein, the term "and/or" includes any and all combinations of one or more of the associated listed items. It will also be appreciated that, when used in this specification, the term "comprising" and/or "comprising" specify the presence and/or components of the features, regions, integers, steps, operations, elements, but do not preclude one or more the presence or addition of other features, regions, steps, operations, elements, components, and/or combinations thereof.

In addition, relative terms such as "under" or "bottom" and "above" or "top" may be used in this paper to describe the relationship between one element and another element, as shown in the figure. It should be understood that the relative terms are intended to encompass different orientations of the device in addition to the orientations shown in the figure. For example, if the device in one attach figure is reversed, the elements described as being on the "under" side of other elements will be directed to being on the "above" side of other elements. Therefore, the example term "under" may include the orientation of "above" and "upper", depending on the particular orientation of the drawings. Similarly, if the device in one attach figure is reversed, the elements described as being on the "under" or "bottom" of other elements will be directed to being on the "above" of other elements. Therefore, the example terms "under" or "bottom" may include the orientations above and under.

All terms (including technical and scientific terms) used herein have the same meaning as commonly understood by one of ordinary skill in the art to which this invention belongs unless otherwise defined. It will be further understood that terms such as those defined in commonly used dictionaries should be interpreted as having meanings consistent with their meaning in the context of the related art and the present invention, and will not be construed as idealized or excessively formal meaning unless explicitly defined in this article.

FIG. 1 is a schematic diagram of a display device 100 according to an embodiment of the present invention. The display device 100 can include a gate driving circuit 110, a source driving circuit 120, and a pixel array 101. the gate driving circuit 110 can sequentially generate and provide a plurality of scanning signals G(1), . . . , G(N) to the pixel array 101 to turn on the complex switches in the pixel array 101, where n is a natural number. The source driving circuit 120 can generate and provide the data voltages d(1), . . . , d(M) to the pixel array 101 so that the pixel array 101 can perform a display operation based on the data voltages d(1), . . . , d(M), where the M is a natural number. Thereby, the display device 100 can display an image.

Figure 2:
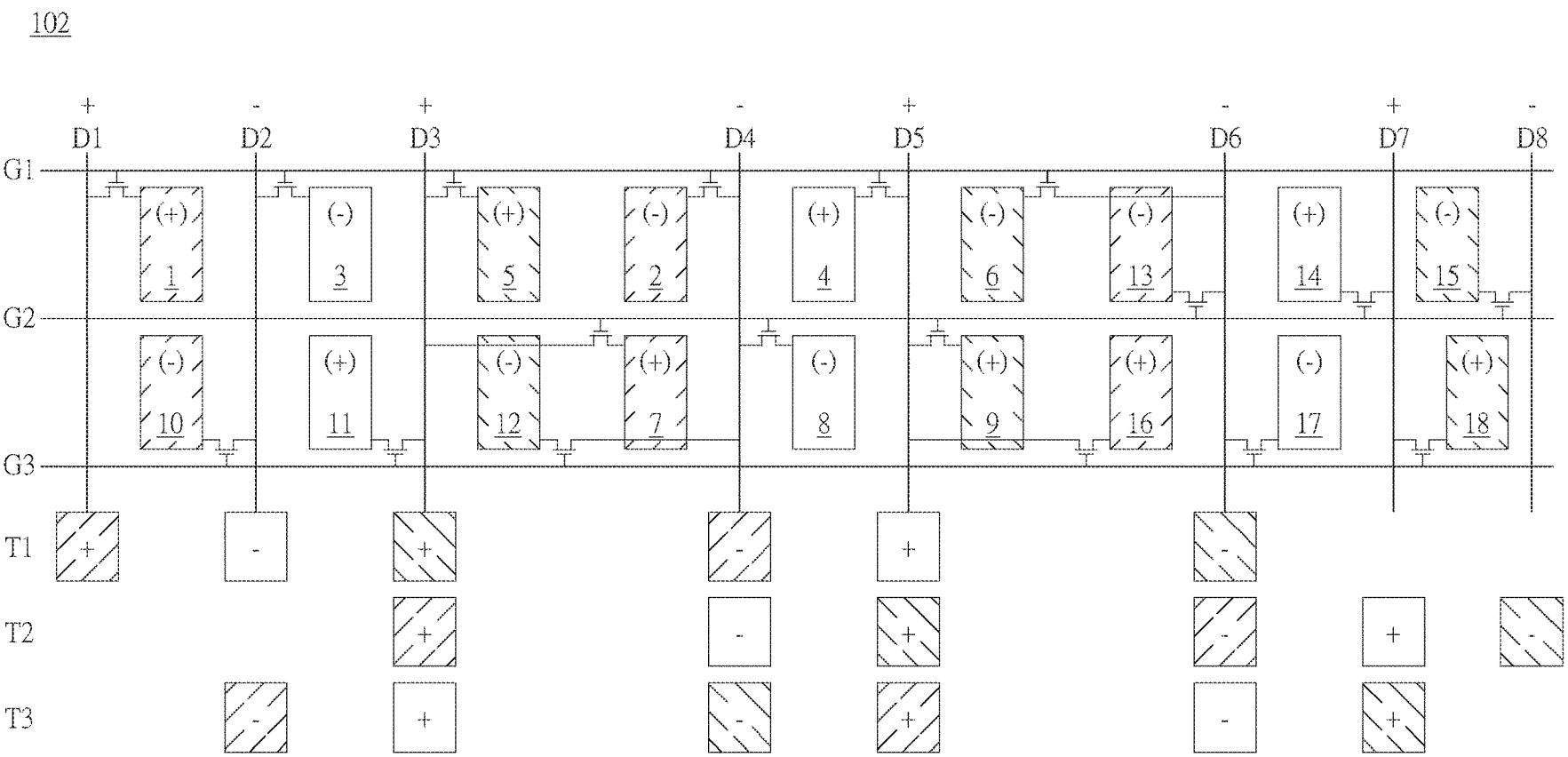
FIG. 2 is a schematic diagram of a display device and related operations in accordance with an embodiment of the present invention.

FIG. 2 is a schematic diagram of a pixel circuit group 102 according to an embodiment of the present invention. In the present embodiment, the pixel array 101 may include a plurality of pixel circuit groups 102 arranged in a matrix. The pixel circuit group 102 includes a plurality of pixel electrodes 1, . . . , 12. The plurality of pixel electrodes 1, . . . , 12 are arranged in a matrix in the pixel circuit group 102. In an embodiment, the plurality of pixel electrodes 1, . . . , 12 include a plurality of first color pixel electrodes, second color pixel electrodes, and third color pixel electrodes. For example, the colors corresponding to the first color pixel electrodes, the second color pixel electrodes, and the third color pixel electrodes may be red green blue, green blue red, or blue red green, respectively, but not limited thereto. In another embodiment, the first color pixel electrodes, the second color pixel electrodes, and the third color pixel electrodes may also be composed of any other colors, but not limited thereto. It should be noted that, in the embodiment of the present invention, the pixel electrodes of three colors are taken as an example for description. However, the number of colors of the pixel electrodes may be changed according to actual needs. For example, the pixel electrodes 1, . . . , 12 may include one, two, and four or more color of the pixel electrodes, the scope of the present invention is not limited to the embodiment.

In the present embodiment, the slash pattern, blank pattern and backslash pattern are shown as different color sub-pixel electrodes in FIG. 2 respectively, but this is not limited thereto. In the following, for the sake of easy reading, the red sub-pixel electrode is represented by a slash pattern, the green sub-pixel electrode is represented by a blank pattern, and the blue sub-pixel electrode is represented by a backslash pattern. This is only for convenience of description but is not limited thereto. In another embodiment, the slash pattern may also be one of the green sub-pixel electrodes or the blue sub-pixel electrodes, and so on. For example, in one embodiment, the pixel electrodes 1, 10, 2, 7, 13, 16 are red sub-pixel electrodes, the pixel electrodes 3, 11, 4, 8, 14, 17 are green sub-pixel electrodes, and the pixel electrodes 5, 12, 6, 9, 15, 18 are blue sub-pixel electrodes.

In the present embodiment, a plurality of scanning lines is configured to sequentially provide a plurality of scanning signals G1, . . . , G3 to a plurality of pixel electrodes in the plurality line times, and one of a plurality of scanning lines electrically connected to corresponding switches of the adjacent two columns pixel electrodes in the plurality of electrode. For example, the scanning signals G1, . . . , G3 are one of the aforementioned scanning signals G (1), . . . , G (N) respectively. The plurality of line times can be the time for each scanning line giving a scanning signal to the corresponding pixel electrode. In this embodiment, there is one scanning line between the upper and lower adjacent pixel electrodes configured to connect the corresponding switches of the pixel electrodes in the two columns pixel electrodes to provide a scanning signal for turning on the switch in the pixel circuit. For example, in an embodiment, the scanning lines located between the two columns pixel electrodes to provide the scanning signal G2 can be electrically connected to the corresponding switches of the upper column pixel electrodes 13, 14, 15 and the corresponding switches of the lower column pixel electrodes 7, 8, 9.

In this embodiment, the plurality of data lines are configured to provide the data voltages D1, . . . , D8 to the pixel electrodes. One of the pluralities of data lines electrically connects to the pixel electrodes located at different rows in the plurality of pixel electrodes. Specifically, the data voltages D1, . . . , D8 is one of the aforementioned data voltages D(1), . . . , D(M) respectively. For example, in one embodiment, the data voltage providing the data line D3 may be electrically connected to the pixel electrode 11 on the left side, the pixel electrode 5 on the right side, and the pixel electrode 7 located at the right side of the pixel electrode 5. The data line providing a data voltage data line D4 may be electrically connected to the pixel electrode 2 on left side, the pixel electrode 12 located at the left side of the pixel electrode 7, and the pixel electrode 8 on the right side, and so on, however not limited thereto.

In one embodiment, the plurality of data lines are configured to provide a plurality of first data voltages and a plurality of second data voltages to the plurality of first color pixel electrodes. The plurality of first data voltages is opposite in polarity to the plurality of second data voltages in the same frame. In an embodiment, the first data voltage and the second data voltage have voltages of opposite polarities in the same frame. For example, in the same frame, if the first data voltage is positive polarity, the second data voltage is negative polarity, but not limited thereto. For the convenience of explanation, the following description is illustrated by taking the first data voltage as positive polarity and the second data voltage as negative polarity. However, in another embodiment, the first data voltage may also be negative polarity, and the second data voltage may also be positive polarity, so the present invention is not limited to the following embodiments. It should be noted that here the positive polarity data voltage and the negative polarity data voltage are relative to the common voltage on the common electrode. For example, when the common voltage is 0V, the positive polarity data voltage can be 0V to +10V, and the negative polarity data voltage can be 0V to −10V. For another example, when the common voltage is +3V, the positive polarity data voltage can be +3V to +13V, and the negative polarity data voltage can be +3V to −7V.

In one embodiment, the scanning line provides the scanning signal G1 to the pixel electrodes 1, 3, 5, 2, 4, 6 in the T1 time (for example, a line time) to turn on the corresponding switch. The plurality of data lines respectively provides positive polarity data voltages D1, D3, D5, and the negative voltage data voltages D2, D4, D6 to the pixel electrodes 1, 5, 4, 3, 2, 6 to conduct display. In the T1 time, the number of red sub-pixel electrodes receiving the data voltage with positive polarity is substantially the same as the number of the red sub-pixel electrodes receiving the data voltage with negative polarity, the number of the green sub-pixel electrodes receiving the data voltages with positive polarity is substantially same as the number of green sub-pixel electrodes receiving the data voltages with negative polarity and the number of blue sub-pixel electrodes receiving the data voltages with positive polarity is substantially the same as the number of blue sub-pixel electrodes receiving the data voltages with negative polarity.

In one embodiment, the scanning line provides the scanning signal G2 to the pixel electrodes 7, 8, 9, 13, 14, 15 in the T2 time to turn on the corresponding switches. The plurality of data lines respectively provides the positive polarity data voltages D3, D5, D7, and the negative polarity data voltages D4, D6, D8 to pixel electrodes 7, 9, 14, 8, 13, 15 to conduct display. In the T2 time, the number of red sub-pixel electrodes receiving the data voltage with positive polarity is substantially the same as the number of the red sub-pixel electrodes receiving the data voltage with negative polarity, the number of the green sub-pixel electrodes receiving the data voltages with positive polarity is substantially same as the number of green sub-pixel electrodes receiving the data voltages with negative polarity and the number of blue sub-pixel electrodes receiving the data voltages with positive polarity is substantially the same as the number of blue sub-pixel electrodes receiving the data voltages with negative polarity.

In one embodiment, the scanning line provides the scanning signal G3 to the pixel electrodes 10, 11, 12, 16, 17, 18 in the T3 time to turn on the corresponding switches. The plurality of data lines respectively provides the positive polarity data voltages D3, D5, D7 and the negative voltage data voltages D2, D4, D6 to the pixel electrodes 11, 16, 18, 10, 12, 17 to conduct display. In the T3 time, the number of red sub-pixel electrodes receiving the positive polarity data voltage is substantially the same as the number of the red sub-pixel electrodes receiving the negative polarity data voltage, the number of the green sub-pixel electrodes receiving the positive polarity data voltages is substantially same as the number of green sub-pixel electrodes receiving the negative polarity data voltages, and the number of blue sub-pixel electrodes receiving the positive polarity data voltages is substantially the same as the number of blue sub-pixel electrodes receiving the negative polarity data voltages.

In the above operation, the T1-T3 times are in the same frame, but the case is not limited thereto.

With the above operation, in each of line time, in the same color of the pixel electrodes, when the number of received the positive polarity data voltage is substantially the same as the number of received the positive polarity data voltages so as to avoid the screen display noise result from pulling the voltages (generally Called Vcom) on the common electrode.

The structure of an embodiment of one of the present invention is described in detail below, the following structure is merely an example, and the present invention is not limited thereto.

Referring to FIG. 2, the scanning line providing the scanning signal G1 is connected to the red sub-pixel electrodes 1 and 2 corresponding switches, the green sub-pixel electrodes 3 and 4 corresponding switches, and the blue sub-pixel electrodes 5 and 6 corresponding switches. In one embodiment, the scanning line providing the scanning signal G2 is connected to the red sub-pixel electrode 7 corresponding switch, the green sub-pixel electrode 8 corresponding switch and the blue sub-pixel electrode 9 corresponding switch. In one embodiment, the scanning line providing the scanning signal G3 is connected to the red sub-pixel electrode 10 corresponding switch, the green sub-pixel electrode 11 corresponding switch, and the blue sub-pixel electrode 12 corresponding switch.

In an embodiment, one or two rows of pixel electrodes can be disposed between two adjacent data lines. For example, between the data line providing the data voltage D3 and the data line providing the data voltage D4 have two rows of pixel electrodes composed of the pixel electrodes 5,12, 2, and 7. Further, the data line providing the data voltage D5 is adjacent to the data line providing the data voltage D4, and between the data line providing the data voltage D4 and the data line providing the data voltage D5 have a row of pixel electrodes composed of the pixel electrodes 4, 8.

In one embodiment, a data line providing a data voltage D1 with positive polarity is connected to the pixel electrode 1, and a data line providing a data voltage D2 with negative polarity is connected to the pixel electrodes 3 and 10, a data line providing a data voltage D3 with positive polarity is connected to the pixel electrodes 5, 7, and 11, and the data line providing a data voltage D4 with negative polarity is connected to the pixel electrodes 2, 8, and 12. The data line providing a data voltage D5 with positive polarity is connected to the pixel electrodes 4 and 9, and the data line providing a data voltage D6 with negative polarity is connected to the pixel electrode 6. In addition, in an embodiment, the data line providing a data voltage D5 with positive polarity can also be connected to the pixel electrode 16, and a data line providing a data voltage D6 with negative polarity may also be connected to the pixel electrodes 13 and 17. The data line providing a data voltage D7 with positive polarity can also be connected to the pixel electrodes 14 and 18, and the data line providing a data voltage D8 with negative polarity can also be connected to the pixel electrode 15.

In an embodiment, in a direction parallel to the scanning line (hereinafter referred to as a first direction), a column of pixel electrodes are sequentially adjacently arranged as pixel electrodes 1, 3, 5, 2, 4, 6, 13, 14, 15 from left to right. For example, the pixel electrodes 3 adjacently arranged on the right side of the pixel electrode 1, and the pixel electrodes 5 are adjacently arranged on the right side of the pixel electrode 3, and so on. On the other hand, in the first direction, a column of pixel electrodes are sequentially adjacently arranged as pixel electrodes 10, 11, 12, 7, 8, 9, 9, 16, 17, and 18 from left to right.

In one embodiment, in the same direction parallel to the data lines (hereinafter, referred to as a second direction), the pixel electrodes 1 are arranged adjacently above the pixel electrodes 10, the pixel electrodes 3 are arranged adjacently above the pixel electrodes 11, the pixel electrodes 5 are arranged adjacently above the pixel electrodes 12, the pixel electrodes 2 are arranged adjacently above the pixel electrodes 7, the pixel electrodes 4 are arranged adjacently above to the pixel electrodes 8, the pixel electrodes 6 are arranged adjacently above the pixel electrodes 9, the pixel electrodes 13 are arranged adjacently above the pixel electrodes 16, the pixel electrodes 14 are arranged adjacently above the pixel electrodes 17, and the pixel electrodes 15 are arranged adjacently above the pixel electrodes 18.

In one embodiment, the polarity of the data voltage received by a pixel electrode is substantially opposite to the polarity of the data voltage received by the adjacent pixel electrode (also referred to as the dot inversion of the polarity). For example, in one embodiment, the blue sub-pixel electrode 5 receiving data voltage with positive polarity is adjacent to the blue sub-pixel electrode 12 receiving the data voltage with negative polarity, the green sub-pixel electrode 3 receiving the data voltage with negative polarity, and the blue sub-pixel electrode 2 receiving the data voltage with negative polarity. For another example, in an embodiment, the green sub-pixel electrode 8 receiving the data voltage with a negative polarity is adjacent to the green sub-pixel electrode 4 receiving the data voltage with positive polarity, the red sub-pixel electrode 7 receiving the data voltage with positive polarity, and the blue sub-pixel electrode 9 receiving the data voltage with positive polarity.

In one embodiment, a data line providing a data voltage with positive polarity is disposed adjacently between two data lines providing a data voltage with negative polarity. For example, in one embodiment, a data line providing a data voltage D3 with positive polarity is disposed adjacently between a data line providing a data voltage D2 with negative polarity and a data line providing a data voltage D4 with negative polarity. A data line providing a data voltage D5 with positive polarity is disposed adjacently between a data line providing a data voltage D4 with negative polarity and a data line providing a data voltage D6 with negative polarity.

Similarly, in one embodiment, a data line providing a data voltage with negative polarity is disposed adjacently between two data lines providing a data voltage with positive polarity. For example, in one embodiment, a data line providing data voltage D2 with a negative polarity is disposed adjacently between a data line providing a data voltage D1 with positive polarity and a data line providing a data voltage D3 with positive polarity. A data line providing data voltage D4 with negative polarity is disposed adjacently between a data line providing a data voltage D3 with positive polarity and the data line providing data voltage D5 with positive polarity.

Figures 3, 4:
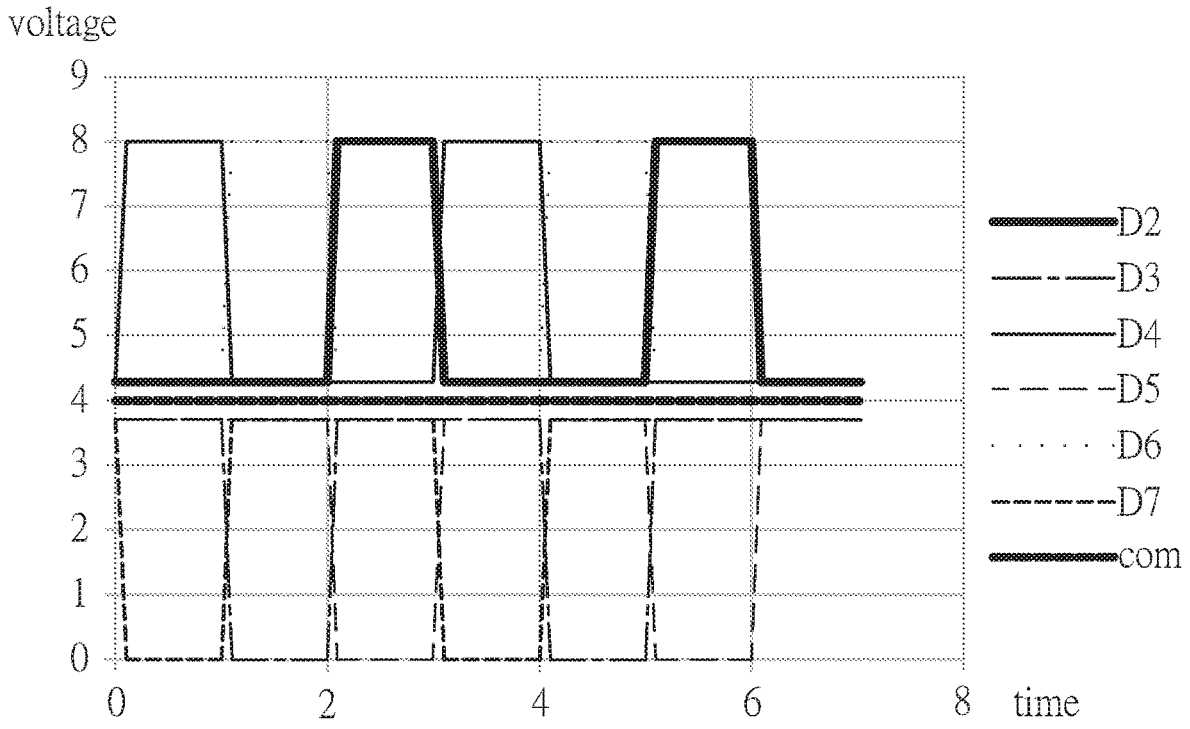
FIG. 3 is a schematic diagram of the operation of a display device according to an embodiment of the invention.
FIG. 4 is a schematic diagram of the signal of a display device according to an embodiment of the present invention.

FIG. 3 is an operation schematic diagram of the display device 100 according to an embodiment of the present invention. As shown in the figure, in each of the times T1, . . . , T6, the number of red sub-pixel electrodes receiving data voltage with positive polarity is substantially the same as the number of red sub-pixel electrodes receiving the data voltage with negative polarity. The number of green sub-pixel electrodes receiving the data voltage with positive polarity is substantially the same as the number of green sub-pixel electrodes receiving the data voltage with negative polarity, and the number of the positive polarity blue sub-pixel electrodes receiving the data voltage with positive polarity is substantially the same as the number of negative blue sub-pixel electrodes receiving the data voltage with negative polarity.

FIG. 4 is a signal schematic diagram of a pixel circuit according to an embodiment of the present invention. With the above pixel circuit architecture, when the number of received the positive polarity data voltage is substantially the same as the number of the received the positive polarity data voltage in the pixel electrode of the same color, the electrodes on the common electrode com of the pixel circuit are maintained the voltage stable at each time point. Further, the display device displays a solid color screen to effectively avoid picture noise (such as horizontal crosstalk (H-corsstalk)).

Figure 5A:
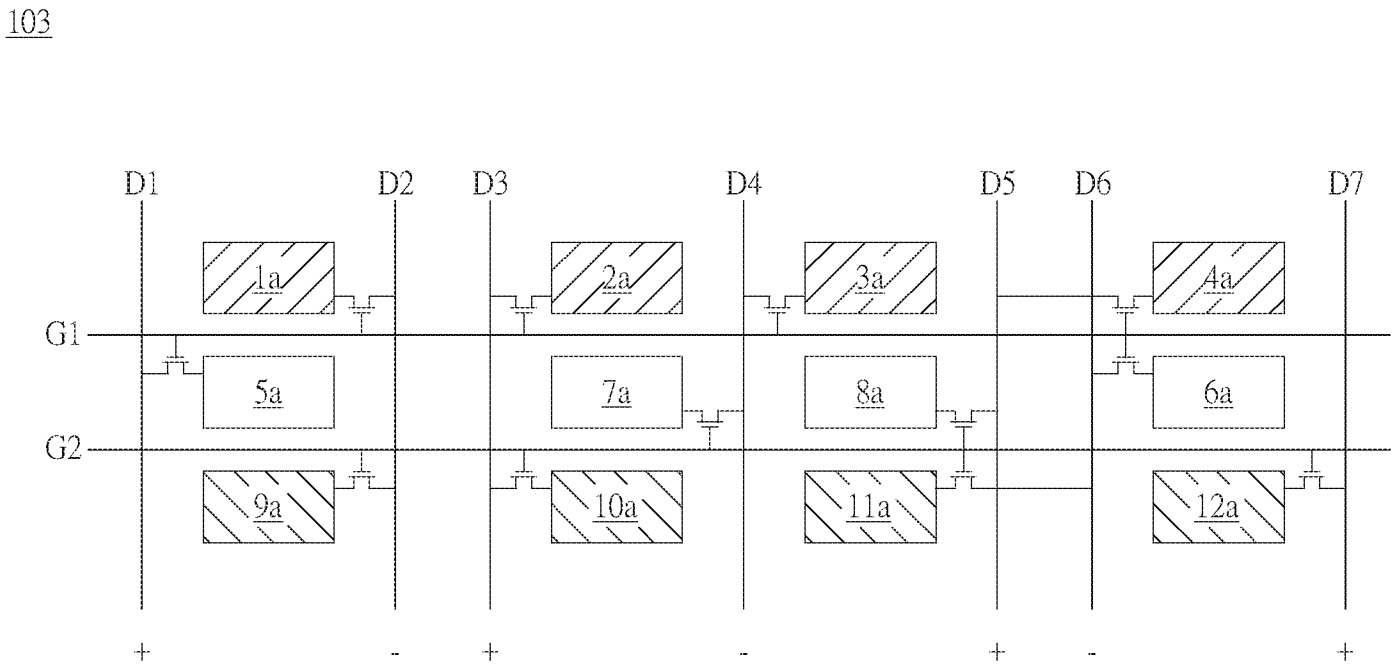
FIG. 5A is a schematic diagram of a display device and related operations according to another embodiment of the present invention.

FIG. 5A is a schematic diagram of a pixel circuit group 103 according to another embodiment of the present invention. In an embodiment, the display device configuration is substantially the same as the foregoing, and will not be described again. The pixel circuit group 103 includes a plurality of pixel electrodes 1*a*, . . . , 12*a*. The plurality of pixel electrodes 1*a*, . . . , 12*a* are arranged in a matrix in the pixel circuit group 103. In an embodiment, the plurality of pixel electrodes 1*a*, . . . , 12*a* include a plurality of the first color pixel electrodes, the second color pixel electrode, and the third color pixel electrode. For example, the colors corresponding to the first color pixel electrodes, the second color pixel electrodes, and the third color pixel electrodes may be red green blue, green blue red, or blue red green, respectively, but not limited thereto. In another embodiment, the first color pixel electrodes, the second color pixel electrodes, and the third color pixel electrodes may also be composed of any other colors, but not limited thereto. It should be noted that, in the embodiment of the present invention, the pixel electrodes of three colors are taken as an example for description. However, the number of colors of the pixel electrodes may be changed according to actual needs. For example, the pixel electrodes 1*a*, . . . , 12*a* may include one, two, and four or more color of the pixel electrodes, the scope of the present invention is not limited to the embodiment.

In the present embodiment, the slash pattern, blank pattern and backslash pattern are shown as different color sub-pixel electrodes in FIG. 5 respectively, but this is not limited thereto. Hereinafter, for the sake of easy reading, the red sub-pixel electrode is represented by a slash pattern, the green sub-pixel electrode is represented by a blank pattern, and the blue sub-pixel electrode is represented by a backslash pattern, which is merely for convenience of description. However, in another embodiment, the slash pattern may also be one of the green sub-pixel electrodes or the blue sub-pixel electrodes, and so on. but not limited thereto. For example, in one embodiment, the pixel electrodes 1*a*, 2*a*, 3*a*, 4*a* are red sub-pixel electrodes, the pixel electrodes 5*a*, 7*a*, 8*a*, 6*a* are green sub-pixel electrodes, and the pixel electrodes 9*a*, 10*a*, 11*a*, 12*a* are blue sub-pixel electrodes.

In this embodiment, in the pixel circuit group 103, a plurality of scanning lines are configured to sequentially provide the plurality of scanning signals G1 and G2 to the plurality of pixel electrodes in the plurality line times, and one of a plurality of scanning lines electrically connected to corresponding switches of the adjacent two columns pixel electrodes in the plurality of electrode. For example, the scanning signal G1 and G2 are one of the aforementioned scanning signals G (1), . . . , G (N) respectively. The plurality of line times can be the time for each scanning line giving a scanning signal to the corresponding pixel electrode. In this embodiment, there is one scanning line between the upper and lower adjacent pixel electrodes configured to connect the corresponding switches of part of the pixel electrodes to provide a scanning signal for turning on the switch in the pixel circuit. For example, in an embodiment, the scanning lines located between the two columns pixel electrodes to provide the scanning signal G2 can be electrically connected to the corresponding switches of the upper column pixel electrodes 7*a*, 8*a* and the corresponding switches of the lower column pixel electrodes 9*a*, 10*a*, 11*a*, 12*a*.

In this embodiment, the plurality of data lines are configured to provide the data voltages D1, . . . , D7 to the pixel electrodes. One of the pluralities of data lines electrically connects to the pixel electrodes located at adjacent two rows in the plurality of pixel electrodes. Specifically, the data voltages D1, . . . , D7 is one of the aforementioned data voltages D(1), . . . , D(M) respectively. For example, in an embodiment, the data line providing the data voltage D4 may be electrically connected to the pixel electrode 7*a* on the left side, the pixel electrode 3*a* on the right side. The data line providing the data voltage D5 can be electrically connected to the pixel electrode 8*a* on the left side and the pixel electrode 4*a* on the right side, and so on, but not limited thereto.

In this embodiment, adjacent first and second ones of the data lines are disposed between adjacent two rows of the pixel electrodes in the pixel electrodes. Specifically, in an embodiment, the data line providing the data voltage D2 and the data line providing the data voltage D3 are disposed between the two rows of pixel electrodes composed of the pixel electrodes 1*a*, 5*a*, 9*a* and 2*a*, 7*a*, 10*a*. In one embodiment, the data line providing the data voltage D5 and the data line providing the data voltage D6 are disposed between the two rows of pixel electrodes composed of the pixel electrodes 3*a*, 8*a*, 11*a* and 4*a*, 6*a*, 12*a*.

In one embodiment, the plurality of data lines are configured to provide a plurality of first data voltages and a plurality of second data voltages to the plurality of first color pixel electrodes. The plurality of first data voltages is opposite in polarity to the plurality of second data voltages in the same frame. In an embodiment, the first data voltage and the second data voltage have voltages of opposite polarities in the same frame. For example, in the same frame, if the first data voltage is positive polarity, the second data voltage is negative polarity, but not limited thereto. For convenience of explanation, the following description is illustrated taking by the first data voltage has a positive polarity, and the second data voltage has a positive polarity, which is merely an example. However, in another embodiment, the first data voltage may also be a negative polarity, and the second data voltage may also be a positive polarity, but not limited thereto. It should be noted that here the positive polarity data voltage and the negative polarity data voltage are relative to the common voltage on the common electrode. For example, when the common voltage is 0V, the positive polarity data voltage can be 0V to +10V, and the negative polarity data voltage can be 0V to −10V. For another example, when the common voltage is +3V, the positive polarity data voltage can be +3V to +13V, and the negative polarity data voltage can be +3V to −7V.

In one embodiment, the scanning line provides the scanning signal G1 to the pixel electrodes 1*a*, 2*a*, 3*a*, 4*a*, 5*a*, 6*a* in the first period (for example, a line time) to turn on the corresponding switch. The plurality of data lines respectively provides data voltages D1, D3, D5 and with positive electrode and the data voltages D2, D4, D6 with negative polarity to the pixel electrodes 5*a*, 2*a*, 4*a*, 1*a*, 3*a*, and 6*a* to conduct display. In the first period, the number of red sub-pixel electrodes receiving the data voltage with positive polarity is substantially the same as the number of the red sub-pixel electrodes receiving the data voltage with negative polarity, the number of the green sub-pixel electrodes receiving the data voltages with positive polarity is substantially same as the number of green sub-pixel electrodes receiving the data voltages with negative polarity and the number of blue sub-pixel electrodes receiving the data voltages with positive polarity is substantially the same as the number of blue sub-pixel electrodes receiving the data voltages with negative polarity.

In an embodiment, the scanning signal G2 is provided to the pixel electrodes 7*a*, 8*a*, 9*a*, 10*a*, 11*a*, 12*a* in the second period (for example, a line time) to turn on the corresponding switch. The plurality of data lines respectively provides the data voltages D3, D5, and D7 with the positive polarity and the data voltages D2, D4, and D6 with negative polarities to the pixel electrodes 10*a*, 8*a*, 12*a*, 9*a*, 7*a*, and 11*a* to conduct display. In the second period, the number of red sub-pixel electrodes receiving the data voltage with positive polarity is substantially the same as the number of the red sub-pixel electrodes receiving the data voltage with negative polarity, the number of the green sub-pixel electrodes receiving the data voltages with positive polarity is substantially same as the number of green sub-pixel electrodes receiving the data voltages with negative polarity and the number of blue sub-pixel electrodes receiving the data voltages with positive polarity is substantially the same as the number of blue sub-pixel electrodes receiving the data voltages with negative polarity.

With the above operation, in each of line time, in the same color of the pixel electrodes, when the number of received the positive polarity data voltage is substantially the same as the number of received the positive polarity data voltages so as to avoid the screen display noise result from pulling the voltages (generally Called Vcom) on the common electrode.

The structure of another embodiment of one of the present invention is described in detail below, the following structure is merely an example, the present invention is not limited thereto.

Referring to FIG. 5A, in one embodiment, the scanning line providing the scanning signal G1 is connected to the corresponding switches of the red sub-pixel electrodes 1*a*, 2*a*, 3*a*, 4*a*, and the corresponding switches of the green sub-pixel electrodes 5*a* and 6*a*. In one embodiment, the scanning line providing the scanning signal G2 is connected to the corresponding switch of the green sub-pixel electrodes 7*a*, 8*a*, and the corresponding switches of the blue sub-pixel electrodes 9*a*, 10*a*, 11*a*, 12*a*.

Figure 5B:
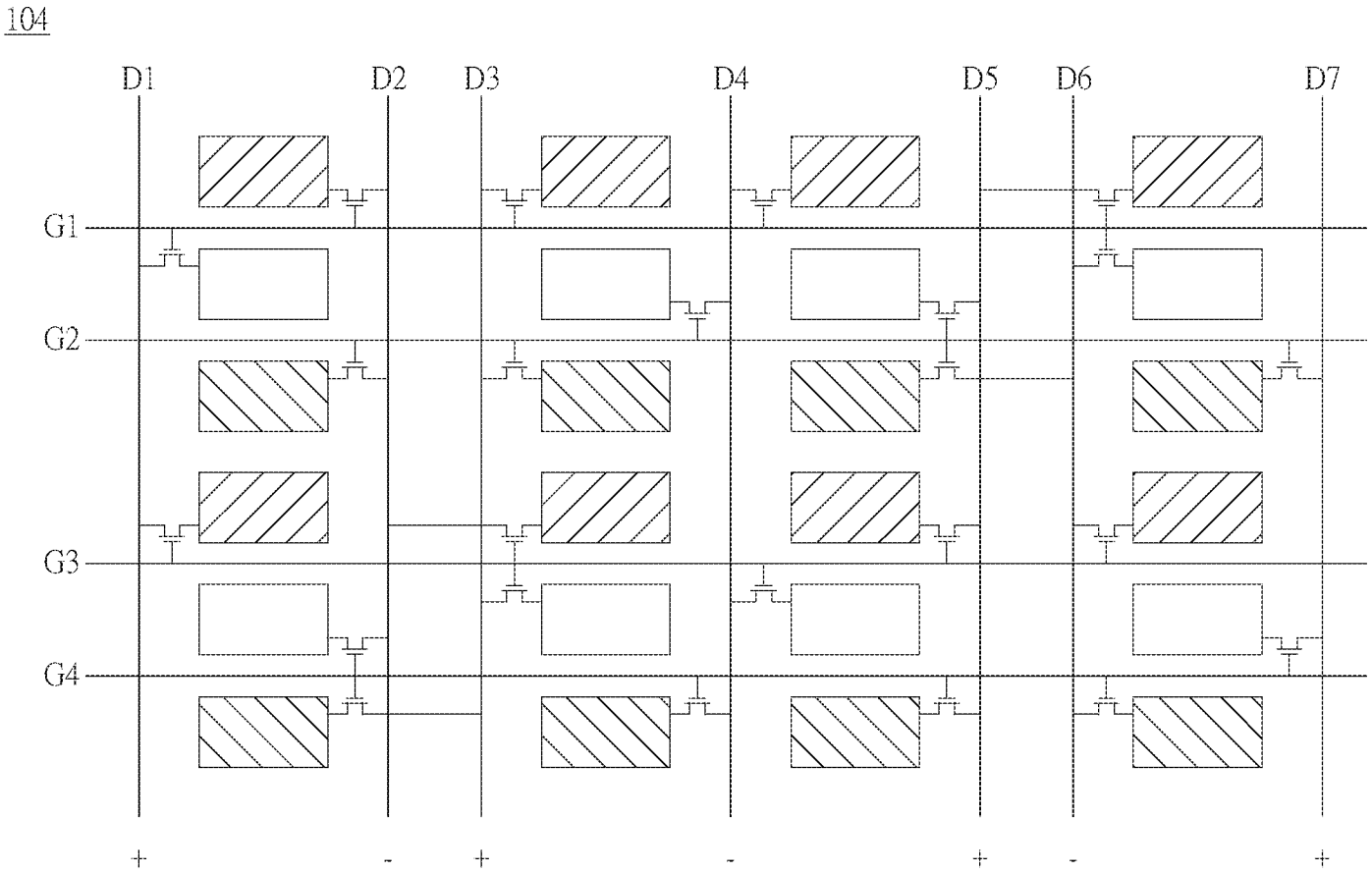
FIG. 5B is a schematic diagram of a display device and related operations according to another embodiment of the present invention.

In one embodiment, two scanning lines are configured to provide scanning signals to three columns of pixel electrodes. That is, one or two columns of pixel electrodes may be disposed between two adjacent scanning lines. FIG. 5B is a schematic diagram of a display device according to another embodiment of the present invention. The pixel circuit group 104 and approximately includes two groups of pixel circuit groups 103, in which details can be referred to in the above paragraph, which will not be repeated here. In one embodiment, there are two columns of pixel electrodes between the scanning line providing the scanning signal G2 and the scanning line providing the scanning signal G3. In addition, the scanning line providing the scanning signal G3 is adjacent to the scanning line providing the scanning signal G4, and the scanning line providing the scanning signal G3 and the scanning line providing the scanning signal G4 have a column of pixel electrodes.

Referring again to FIG. 5A, in an embodiment, a data line providing data voltage D1 with positive polarity is connected to the pixel electrode 5*a*, a data line providing data voltage D2 with negative polarity is connected to the pixel electrodes 1*a* and 9*a*. The data line providing data voltage D3 with positive polarity is connected to the pixel electrodes 2*a* and 10*a*, the data line providing data voltage D4 with negative polarity is connected to the pixel electrodes 3*a*, 7*a*, the data line providing the data voltage D5 with positive polarity is connected to the pixel electrodes 4*a* and 8*a*, the data line providing the data voltage D6 with negative polarity is connected to the pixel electrodes 6*a* and 11*a*, and the data line providing the data voltage D7 with positive polarity is connected to the pixel electrode 12*a*.

In an embodiment, in a direction parallel to the scan line (hereinafter referred to as a first direction), a column of pixel electrodes are sequentially adjacently arranged from left to right as pixel electrodes 1*a*, 2*a*, 3*a*, 4*a*, for example, the pixel electrodes 2*a* are adjacently arranged on the right side of the pixel electrode 1*a*, and the pixel electrodes 3*a* are adjacently arranged on the right side of the pixel electrode 2*a*, and so on. Further, in the first direction, a column of pixel electrodes is sequentially adjacently arranged from left to right as the pixel electrodes 5*a*, 7*a*, 8*a*, 6*a*. On the other hand, in the first direction, a column of pixel electrodes are sequentially adjacently arranged from left to right as pixel electrodes 9*a*, 10*a*, 11*a*, 12*a*.

In an embodiment, in the same direction parallel to the data line (hereinafter referred to as the second direction), the pixel electrodes are sequentially adjacently arranged as the pixel electrodes 1*a*, 5*a*, 9*a* from top to bottom, the pixel electrodes are sequentially adjacently arranged as the pixel electrodes 2*a*, 7*a*, 10*a* from top to bottom, the pixel electrodes are sequentially adjacently arranged as pixel electrodes 3*a*, 8*a*, 11*a* from top to bottom, the pixel electrodes are sequentially adjacently arranged as pixel electrodes 4*a*, 6*a*, 12*a* from top to bottom.

In one embodiment, the polarity of the data voltage received by a pixel electrode is substantially opposite to the polarity of the data voltage received by the adjacent pixel electrodes (also referred to as the dot inversion of polarity). For example, in one embodiment, the green sub-pixel electrode 8*a* receiving the data voltage with positive polarity is adjacent to the green sub-pixel electrode 7*a* receiving the data voltage with negative polarity, the red sub-pixel electrode 3*a* receiving the data voltage with negative polarity, and the blue sub-pixel electrode 11*a* receiving the data voltage with a negative polarity. For another example, in an embodiment, the green sub-pixel electrode 6*a* receiving the data voltage with negative polarity is adjacent to the green sub-pixel electrode 8*a* receiving the data voltage with positive polarity, the red sub-pixel electrode 4*a* receiving the data voltage with positive polarity, and the blue sub-pixel electrode 12*a* receiving the data voltage with positive polarity.

In one embodiment, the polarity of the data voltage received by a pixel electrode is substantially opposite to the polarity of the data voltage received by the adjacent pixel electrodes (also referred to as the dot inversion of polarity). For example, in one embodiment, the green sub-pixel electrode 8*a* receiving the data voltage with positive polarity is adjacent to the green sub-pixel electrode 7*a* receiving the data voltage with negative polarity, the red sub-pixel electrode 3*a* receiving the data voltage with negative polarity, and the blue sub-pixel electrode 11*a* receiving the data voltage with a negative polarity. For another example, in an embodiment, the green sub-pixel electrode 6*a* receiving the data voltage with negative polarity is adjacent to the green sub-pixel electrode 8*a* receiving the data voltage with positive polarity, the red sub-pixel electrode 4*a* receiving the data voltage with positive polarity, and the blue sub-pixel electrode 12*a* receiving the data voltage with positive polarity.

Similarly, in one embodiment, the data line providing data voltage with negative polarity is disposed between two data lines providing data voltage with positive polarity. For example, in one embodiment, the data line providing data voltage D2 with negative polarity is disposed between the data line providing data voltage D1 with positive polarity and the data line providing data voltage D3 with positive polarity. The data line providing data voltage D4 with negative polarity is disposed between the data line providing data voltage D3 with the positive polarity and the data line providing data voltage D5 with positive polarity.

As a preferably embodiment, wherein the pixel electrodes further include a plurality of second color pixel electrodes and a plurality of third color pixel electrodes; wherein, the data lines are configured to provide a plurality of third data voltages and a plurality of fourth data voltages to the second color pixel electrodes, and configured to provide a plurality of fifth data voltages and a plurality of sixth data voltages to the third color pixel electrodes, the third data voltages are opposite in polarity to the fourth data voltages in the same frame, and the fifth data voltages are opposite in polarity to the sixth data voltages in the same frame; and in each of the line times, the number of the second color pixel electrodes receiving the third data voltages are substantially equal to the number of the second color pixel electrodes receiving the fourth data voltages, the number of the third color pixel electrodes receiving the fifth data voltages are substantially equal to the number of the third color pixel electrodes receiving the sixth data voltages; wherein the first data voltages, the third data voltages, and the fifth data voltages have the same polarity in the same frame, the second data voltages, the four data voltages, and the sixth data voltages having the same polarity in the same frame; wherein, the pixel electrode of the first color pixel electrode receiving one of the first data voltages is adjacent to the pixel electrode of the first color pixel electrode receiving one of the second data voltages, the pixel electrode of the second color pixel electrode receiving one of the fourth data voltages, and the pixel electrode of the third color pixel electrode receiving one of the sixth data voltages; and the pixel electrode of the first color pixel electrodes receiving one of the second data voltages is adjacent to the pixel electrodes of the first color pixel electrodes receiving one of the first data voltages, the pixel electrode of the second color pixel electrodes receiving one of the third data voltages, and the pixel electrode of the third color pixel electrodes receiving one of the fifth data voltages.

Figure 6:
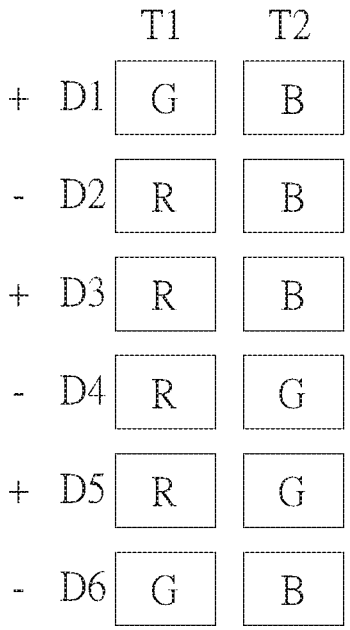
FIG. 6 is a schematic diagram of a display device according to another embodiment of the present invention.

FIG. 6 is a schematic diagram showing an operational state of a display device 100 according to an embodiment of the invention. In an embodiment, the scanning lines provide scanning signals to turn on a plurality of corresponding switches in the pixel circuit and cause the pixel circuit to perform a display operation according to the data voltage. Referring to FIG. 6, for example, in one embodiment, in each of the T1 and T2 times, the number of received the red sub-pixel electrodes with positive polarity data voltage is substantially same as to the number of received the red sub-pixel electrode with negative polarity data voltage, the number of received the green sub-pixel electrodes with positive polarity data voltage is substantially the same as the number of received the green sub-pixel electrodes with negative polarity data voltage, and the number of received the blue sub-pixel electrodes with positive polarity data voltage is substantially same as the number of received blue sub-pixel electrodes with negative polarity data voltage. It should be noted that the above T1-T2 times are in the same frame.

By the foregoing operation, in each of line times, in the same color of the pixel electrodes, when the number of received the positive polarity data voltage is substantially the same as the number of received the positive polarity data voltage that that can avoid pulling the voltage on the common voltage caused screen display noise.

Figure 7:
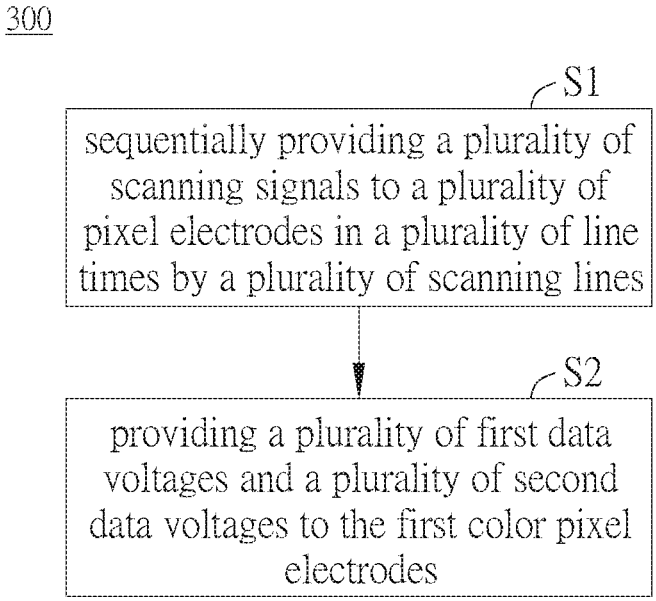
FIG. 7 is a flowchart of a driving method of a display device according to an embodiment of the present invention.

FIG. 7 is a flow chart of a pixel circuit driving method according to an embodiment of the present invention.

The driving method 300 can be applied to a display device 100 having the same or similar structure as shown in FIG. 2. For the sake of simplicity, according to an embodiment of the present invention, the driving method 300 will be described below by taking the display device 100 having the structure shown in FIG. 2 as an example, but the present invention is not limited to this application.

In addition, it should be understood that unless the order is specifically described, the operation of the driving method 300 mentioned in the embodiment can be adjusted its sequence according to actual needs, even executed simultaneously or partially simultaneously.

Further, in different embodiments, these operations may also be adaptively added, replaced, and/or omitted.

In operation S1, through a plurality of the scanning lines, the pixel circuit group 102 sequentially provides a plurality of scanning signals G1, . . . , G3 to the corresponding switches of the plurality of pixel electrodes 1, . . . , 12 in the plurality of line times. In an embodiment, the plurality of pixel electrodes 1, . . . , 12 can include red sub-pixel electrodes, green sub-pixel electrodes, and blue sub-pixel electrodes, but not limited thereto.

In operation S2, the pixel circuit group 102 provides a plurality of first data voltages and a plurality of second data voltages to the first color pixel electrodes. In an embodiment, the first data voltage can be D1, the second data voltage can be D4, and the first color pixel electrodes can be the red sub-pixel electrode 1 and 2, but not limited thereto. In one embodiment, the red sub-pixel electrode 1, 2 respectively receives a data voltage D1 with positive polarity and a data voltage D2 with negative polarity. In each of the line times, the number of positive polarity red sub-pixel electrodes is substantially equal to the number of negative polarity red sub-pixel electrodes to keep the common voltage stable.

According to the above pixel circuit architecture, when the display device displays a solid color image, the number of received the positive polarity data voltage in the pixel electrode of the same color is substantially equal to the number of received the positive polarity data voltage, thereby effectively avoiding the display device image noise.

It should be noted that the specific details of the above operations can be referred to the foregoing paragraphs, and thus will not be described herein.

Although the present invention has been disclosed in the above embodiments, it is not intended to limit the present invention. Any person who is skilled in the art can be regarded as various modifications and retouching without departing from the spirit and scope of the present invention. Therefore, the scope of protection of the present invention shall be determined by the scope of the patent application attached hereto.

What is claimed is:

1. A display device, including:

a plurality of pixel electrodes arranged in a matrix, wherein the pixel electrodes include a plurality of first color pixel electrodes, a plurality of second color pixel electrodes and a plurality of third color pixel electrodes;

a plurality of scanning lines, for sequentially providing a plurality of scanning signals to switches corresponding to the pixel electrodes in a plurality of line times, wherein one of the scanning lines electrically connects to switches corresponding to adjacent two columns of pixel electrodes in the pixel electrodes;

a plurality of data lines, wherein one of the data lines is electrically connected to the pixel electrodes located at different rows in the pixel electrodes;

wherein the data lines are configured to provide a plurality of first data voltages and a plurality of second data voltages to a first color pixel electrode, the polarity of the first data voltages are opposite to the polarity of the second data voltages in the same frame; and in each of line times, the number of the first color pixel electrodes receiving the first data voltage is substantially equal to the number of the first color pixel electrodes receiving the second data voltages;

wherein, the data lines are configured to provide a plurality of third data voltages and a plurality of fourth data voltages to the second color pixel electrodes, and configured to provide a plurality of fifth data voltages and a plurality of sixth data voltages to the third color pixel electrodes, the third data voltages are opposite in polarity to the fourth data voltages in the same frame, and the fifth data voltages are opposite in polarity to the sixth data voltages in the same frame;

in each of the line times, the number of the second color pixel electrodes receiving the third data voltages are substantially equal to the number of the second color pixel electrodes receiving the fourth data voltages, the number of the third color pixel electrodes receiving the fifth data voltages are substantially equal to the number of the third color pixel electrodes receiving the sixth data voltages;

wherein a first scanning line of the scanning lines is electrically connected to switches corresponding to a first pixel electrode and a second pixel electrode in the first color pixel electrodes, switches corresponding to a third pixel electrode and a fourth pixel electrode in the second color pixel electrodes, and switches corresponding to a fifth pixel electrode and a sixth pixel electrode in the third color pixel electrodes;

a second scanning line of the scanning lines is electrically connected to a switch corresponding to a seventh pixel electrode in the first color pixel electrodes, an eighth pixel electrode in the second color pixel electrodes, and a switch corresponding to a ninth pixel electrode in the third color pixel electrodes;

a third scanning line of the scanning lines is electrically connected to a switch corresponding to a tenth pixel electrode in the first color pixel electrodes, a switch corresponding to an eleventh pixel electrode in the second color pixel electrodes, and a switch corresponding to a twelfth pixel electrode in the third color pixel electrodes;

a first data line of the data lines is electrically connected to the first pixel electrode;

a second data line of the data lines is electrically connected to the third pixel electrode and the tenth pixel electrode;

a third data line of the data lines is electrically connected to the fifth pixel electrode, the seventh pixel electrode, and the eleventh pixel electrode;

a fourth data line of the data lines is electrically connected to the second pixel electrode, the eighth pixel electrode, and the twelfth pixel electrode;

a fifth data line of the data lines is electrically connected to the fourth pixel electrode and the ninth pixel electrode; and a sixth data line of the data lines is electrically connected to the sixth pixel electrode.

2. The display device according to claim 1, wherein in a first direction, the first pixel electrode, the third pixel electrode, the fifth pixel electrode, the second pixel electrode, the fourth pixel electrode, and the sixth pixel electrode are arranged adjacent to each other in sequence;

in the first direction, the tenth pixel electrode, the eleventh pixel electrode, the twelfth pixel electrode, the seventh pixel electrode, the eighth pixel electrode, and the ninth pixel electrode are arranged adjacent to each other in sequence;

and in a second direction, the first pixel electrode and the tenth pixel electrode are adjacent to each other, the third pixel electrode and the eleventh pixel electrode are adjacent to each other, the fifth pixel electrode and the twelfth pixel electrode are adjacent to each other, the second pixel electrode and the seventh pixel electrode are adjacent to each other, the fourth pixel electrode and the eighth pixel electrode are adjacent to each other, and the sixth pixel electrode and the ninth pixel electrode are adjacent to each other.

3. The display device according to claim 1, wherein the first color pixel electrodes, the second color pixel electrodes, and the third color pixel electrodes are respectively the red sub-pixel electrodes, the green sub-pixel electrodes, and the blue sub-pixel electrodes.

4. The display device according to claim 1, wherein the first data voltages, the third data voltages, and the fifth data voltages have the same polarity in the same frame, and the second data voltages, the four data voltages and the sixth data voltages have the same polarity in the same frame;

wherein the data lines providing one of the first data voltages, the third data voltages, and the fifth data voltages are adjacently disposed between two data lines that providing two of the second data voltage, the fourth data voltage, and the sixth data voltages respectively;

and wherein the data lines providing one of the second data voltages, the fourth data voltages, and the sixth data voltages are adjacently disposed between two data lines that providing two of the first data voltages, the third data voltage, and the fifth data voltages, respectively.

5. The display device according to claim 1, wherein two adjacent rows of the pixel electrodes in the matrix are disposed between one of the first lines and one of the second data lines that are adjacent to each other.

6. The display device according to claim 5, wherein a row of the pixel electrodes in the matrix are disposed between one of the second lines and one of the third data lines that are adjacent to each other.

7. A display device including:

a plurality of pixel electrodes arranged in a matrix, wherein the pixel electrodes include a plurality of first color pixel electrodes, a plurality of second color pixel electrodes and a plurality of third color pixel electrodes;

a plurality of scanning lines for sequentially providing a plurality of scanning signals to the corresponding switches of the pixel electrodes in a plurality of line times, wherein one of the scanning lines is electrically connected to corresponding switch of adjacent two rows pixel electrodes of the pixel electrodes;

a plurality of data lines, wherein one of the data lines is electrically connected to adjacent two rows pixel electrodes of the pixel electrodes, and wherein the data lines of a first and adjacent to a second are disposed between adjacent two rows of the pixel electrodes;

wherein the data lines are configured to provide a plurality of first data voltages and a plurality of second data voltages to first color pixel electrode, the polarity of the first data voltages are opposite to the polarity of the second data voltages in the same frame, in each of line times, the number of the first color pixel electrodes receiving the first data voltage are substantially equal to the number of the first color pixel electrodes receiving the second data voltages;

wherein the data lines are configured to provide a plurality of third data voltages and a plurality of fourth data voltages to the second color pixel electrodes, and configured to provide a plurality of fifth data voltages and a plurality of sixth data voltages to the third color pixel electrodes, the third data voltages are opposite in polarity to the fourth data voltages in the same frame, and the fifth data voltages are opposite in polarity to the sixth data voltages in the same frame;

and in each of line times, the number of the second color pixel electrodes receiving the third data voltage is substantially equal to the number of the second color pixel electrodes receiving the forth data voltages, the number of the third color pixel electrodes receiving the fifth data voltages is substantially equal to the number of the third color pixel electrodes receiving the sixth data voltages;

wherein a first scanning line of the scanning lines is electrically connected to corresponding switches of a first pixel electrode, a second pixel electrode, a third pixel electrode and a forth pixel electrode in the first color pixel electrodes, corresponding switches of a fifth pixel electrode and a sixth pixel electrode in the second color pixel electrode;

a second scanning line of the scanning lines is electrically connected to corresponding switches of a seventh pixel electrode and a eighth pixel electrode in the second color pixel electrodes, corresponding switches of a ninth pixel electrode, a tenth pixel electrode, a eleventh pixel electrode, and a twelfth pixel electrode in the third color pixel electrodes;

a first data line of the data lines is electrically connected to the fifth pixel electrode;

a second data line of the data lines is electrically connected to the first pixel electrode and the ninth pixel electrode;

a third data line of the data lines is electrically connected to the second pixel electrode and the tenth pixel electrode;

a fourth data line of the data lines is electrically connected to the third pixel electrode and the seventh pixel electrode;

a fifth data line of the data lines is electrically connected to the fourth pixel electrode and the eighth pixel electrode;

a sixth data line of the data lines is electrically connected to the sixth pixel electrode and the eleventh pixel electrode;

a seventh data line of the data lines is electrically connected to the twelfth pixel electrode.

8. The display device according to claim 7, wherein the first pixel electrode, the second pixel electrode, the third pixel electrode, and the fourth pixel electrode are sequentially adjacent to each other in a first direction;

in the first direction, the fifth pixel electrode, the seventh pixel electrode, the eighth pixel electrode, and the sixth pixel electrode are adjacently arranged in sequence;

in the first direction, the ninth pixel electrode, the tenth pixel electrode, the eleventh pixel electrode, and the twelfth pixel electrode are adjacently arranged in sequence;

in a second direction, the first pixel electrode, the fifth pixel electrode, and the ninth pixel electrode are adjacently arranged in sequence;

in the second direction, the second pixel electrode, the seventh pixel electrode and the tenth pixel electrode are adjacently arranged in sequence;

in the second direction, the third pixel electrode, the eighth pixel electrode, and the eleventh pixel electrode are adjacently arranged in sequence;

in the second direction, the fourth pixel electrode, the sixth pixel electrode, and the twelfth pixel electrode are adjacently arranged in sequence.

9. The display device according to claim 7, wherein the first color pixel electrode, the second color pixel electrode, and the third color pixel electrode are respectively the red sub-pixel electrodes, the green sub-pixel electrodes, and the blue sub-pixel electrodes.

10. The display device according to claim 7, wherein the first data voltages, the third data voltages, and the fifth data voltages have the same polarity in the same frame, and the second data voltages, the four data voltages and the sixth data voltages having the same polarity in the same frame;

wherein, the pixel electrode of the first color pixel electrode receiving one of the first data voltages is adjacent to the pixel electrode of the first color pixel electrode receiving one of the second data voltages, the pixel electrode of the second color pixel electrode receiving one of the fourth data voltages, and the pixel electrode of the third color pixel electrode receiving one of the sixth data voltages;

and the pixel electrode of the first color pixel electrodes receiving one of the second data voltages are adjacent to the pixel electrodes of the first color pixel electrodes receiving one of the first data voltages, the pixel electrode of the second color pixel electrodes receiving one of the third data voltages, and the pixel electrode of the third color pixel electrodes receiving one of the fifth data voltages.

11. The display device according to claim 7, wherein two adjacent rows of the pixel electrodes in the matrix are disposed between one of the first lines and one of the second data lines that are adjacent to each other.

12. The display device of claim 11, wherein a row of the pixel electrodes in the matrix are disposed between one of the second lines and one of the third data lines that are adjacent to each other.

13. A driving method of a display device, including: sequentially providing a plurality of scanning signals to the corresponding switches of a plurality of pixel electrodes in a plurality of line times by a plurality of scanning lines, wherein one of the scanning lines is electrically connected to corresponding switches of adjacent two rows of pixel electrodes in the pixel electrodes, the pixel electrodes are arranged in a matrix, and the pixel electrodes includes a plurality of first color pixel electrodes, a plurality of second color pixel electrodes and a plurality of third color pixel electrodes;

wherein the data lines of a first and adjacent to a second are disposed between adjacent two rows of the pixel electrodes;

providing a plurality of first data voltages and a plurality of second data voltages to the first color pixel electrodes, wherein the first data voltages are opposite in polarity to the second data voltages in the same frame, and in each of line times, the number of the first color pixel electrodes receiving the first data voltages are substantially equal to the number of the first color pixel electrodes receiving the second data voltages;

wherein the data lines are configured to provide a plurality of third data voltages and a plurality of fourth data voltages to the second color pixel electrodes, and configured to provide a plurality of fifth data voltages and a plurality of sixth data voltages to the third color pixel electrodes, the third data voltages are opposite in polarity to the fourth data voltages in the same frame, and the fifth data voltages are opposite in polarity to the sixth data voltages in the same frame; and in each of line times, the number of the second color pixel electrodes receiving the third data voltage is substantially equal to the number of the second color pixel electrodes receiving the forth data voltages, the number of the third color pixel electrodes receiving the fifth data voltages is substantially equal to the number of the third color pixel electrodes receiving the sixth data voltages;

wherein a first scanning line of the scanning lines is electrically connected to corresponding switches of a first pixel electrode, a second pixel electrode, a third pixel electrode and a forth pixel electrode in the first color pixel electrodes, corresponding switches of a fifth pixel electrode and a sixth pixel electrode in the second color pixel electrode;

a second scanning line of the scanning lines is electrically connected to corresponding switches of a seventh pixel electrode and a eighth pixel electrode in the second color pixel electrodes, corresponding switches of a ninth pixel electrode, a tenth pixel electrode, a eleventh pixel electrode, and a twelfth pixel electrode in the third color pixel electrodes;

a first data line of the data lines is electrically connected to the fifth pixel electrode;

a second data line of the data lines is electrically connected to the first pixel electrode and the ninth pixel electrode;

a third data line of the data lines is electrically connected to the second pixel electrode and the tenth pixel electrode;

a fourth data line of the data lines is electrically connected to the third pixel electrode and the seventh pixel electrode;

a fifth data line of the data lines is electrically connected to the fourth pixel electrode and the eighth pixel electrode;

a sixth data line of the data lines is electrically connected to the sixth pixel electrode and the eleventh pixel electrode;

a seventh data line of the data lines is electrically connected to the twelfth pixel electrode.

* * * * *